US006662900B2

(12) United States Patent
Cathcart et al.

(10) Patent No.: US 6,662,900 B2
(45) Date of Patent: Dec. 16, 2003

(54) CROSS-EXIT EXHAUST SYSTEM

(75) Inventors: John D Cathcart, Lake Orion, MI (US); James P Salmonowicz, St. Clair Shores, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/032,441

(22) Filed: Dec. 21, 2001

(65) Prior Publication Data

US 2003/0116378 A1 Jun. 26, 2003

(51) Int. Cl.[7] ..... F01N 7/10
(52) U.S. Cl. ..... 181/240
(58) Field of Search ..... 181/240, 238, 181/239, 257, 268, 212, 251

(56) References Cited

U.S. PATENT DOCUMENTS

| | | | | | |
|---|---|---|---|---|---|
| 4,359,865 | A | * | 11/1982 | Nakao et al. | 60/313 |
| 4,800,719 | A | | 1/1989 | Campbell | 60/313 |
| 5,351,481 | A | * | 10/1994 | Flugger | 60/273 |
| 5,974,784 | A | * | 11/1999 | Feldman | 60/272 |
| 6,182,446 | B1 | * | 2/2001 | Gunther et al. | 60/278 |
| 6,247,305 | B1 | * | 6/2001 | Bassani | 60/312 |

* cited by examiner

*Primary Examiner*—Shih-Yung Hsieh

(57) ABSTRACT

An exhaust system features first and second exhaust conduits fluidly coupled to first and second cylinder banks of an associated internal combustion engine. The first and second conduits cross over each other downstream of the engine and are coupled together by a common chamber. The common chamber allows pressure pulses in the first and second conduits flowing past the chamber in opposite directions to at least partially cancel each other, thereby reducing low frequency exhaust noise.

6 Claims, 1 Drawing Sheet

CROSS-EXIT EXHAUST SYSTEM

BACKGROUND OF THE INVENTION

The present invention relates to exhaust systems in general and to cross-exit exhaust systems utilizing cross coupling via a common chamber to interconnect different portions of the exhaust system for silencing purposes.

Prior art approaches to noise reduction, especially in higher performance engines, has been obtained by utilizing cross coupling passageways between left and right exhaust conduits coming from opposite sides of the engine block from manifolds associated with a particular bank of cylinders. Such approaches have been commonly referred to as "H-pipe" or "X-pipe" exhaust configurations. One example of the X-pipe approach, which essentially is a variation of the older H-pipe approach is shown in U.S. Pat. No. 4,800,719.

All the known prior approaches utilizing the H or X-pipe interconnection schemes involve passing exhaust gases and associated pressure pulses in the first and second (or left and right) exhaust pipes coming from the opposite sides of the engine past the common cross-over point wherein the exhaust and associated pressure pulses are flowing past that common chamber in the same direction.

We have found that improved cancellation of low frequency exhaust noise is attained in such cross coupling exhaust systems where the gases and related pressure pulses flow past the connection point, or common chamber, in opposite directions.

SUMMARY OF THE INVENTION

Accordingly, an exhaust system for use in a vehicle having an internal combustion engine with first and second cylinder banks, each having respective first and second exhaust manifolds, comprises a first conduit adapted to be coupled to the first manifold, a second conduit adapted to be coupled to the second manifold, said first and second conduits extending toward each other downstream of their respective manifolds to a cross-over point, and a common chamber in fluid communication with the first and second conduits substantially at the cross-over point, whereby exhaust gases and associated pressure pulses in the first conduit flow past the common chamber in a direction substantially opposite to flow of exhaust gases and associated pressure pulses in the second conduit.

BRIEF DESCRIPTION OF THE DRAWING

The objects and features of the invention will become apparent from the detailed description taken in conjunction with the drawing, in which.

DETAILED DESCRIPTION OF THE PREFERRED EMBODIMENTS

Figure 1:
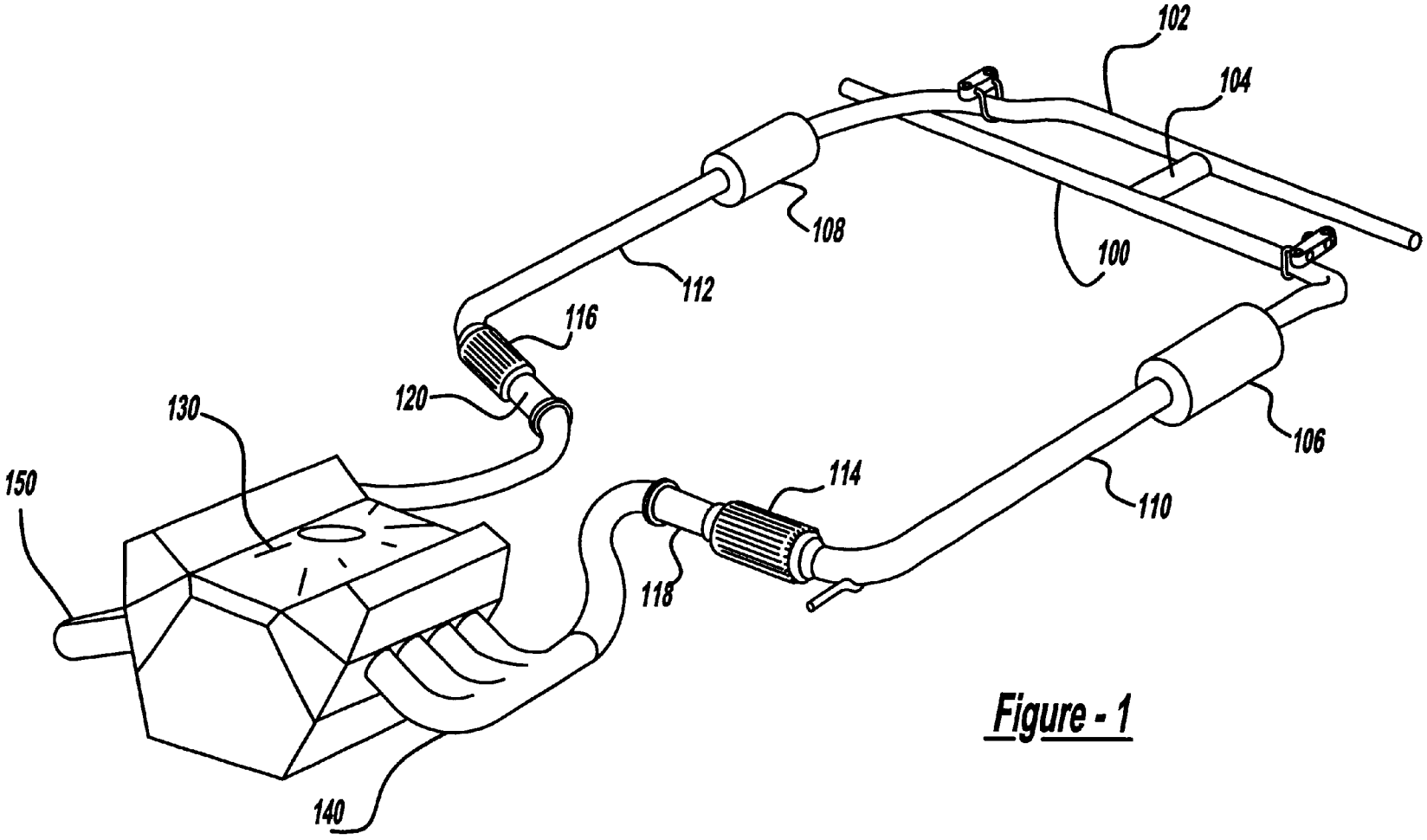
FIG. 1 is a perspective view of a cross-over exhaust system arranged in accordance with the principles of the invention.

With reference to FIG. 1, a typical internal combustion engine 130 has first and second (or right and left) cylinder banks with exhaust ports each emptying into a first manifold 140 and a second manifold 150.

The output of each manifold 140 and 150 is respectively fluidly coupled to exhaust conduits 118 and 120.

Exhaust conduit 118 is coupled to an input of catalytic converter 114. The output of converter 114 is coupled to exhaust conduit 110 which is, in turn, coupled to an input of muffler 106.

Similarly, exhaust conduit 120 is coupled to an input of catalytic converter 116. The output of converter 116 is coupled to exhaust conduit 112 which is, in turn, coupled to an input of muffler 108.

Exhaust conduits 100 and 102, respectively coupled to outputs of mufflers 106 and 108, then turn inwardly toward a longitudinal axis of the vehicle where conduits 100 and 102 reach a cross-over point substantially at the longitudinal axis of the vehicle. At this cross-over point is located a common chamber 104 coupled for fluid communication with exhaust conduits 100 and 102.

Once each tube 100 and 102 extends past the cross-over point and common chamber 104, each conduit then extends further to a side of the vehicle where it terminates, thus providing cross exits for the exhaust system.

With the arrangement as shown, exhaust gases and their associated pressure pulses emanating from engine manifolds 140 and 150 cross over from their originating sides in the vicinity of the common chamber 104 which results in equalization of the pressure pulses from the gas stream traveling in opposite directions past chamber 104. This has been found to substantially reduce low frequency exhaust noise.

It is believed that with the exhaust gases and associated pressure pulses flowing against each other in common chamber 104, the mixing of the pulses and their sound streams is more thorough, resulting in improved noise reduction at the output of the exhaust system.

It should also be noted that the volume of chamber 104 may be chosen, for a particular application, to provide an optimum tuning chamber for that application. The choice is usually determined by experimenting with various cross sectional areas and lengths of chamber 104.

The invention has been described with reference to an exemplary embodiment for the sake of example only. The scope and spirit of the invention are to be derived from appropriately interpreting the appended claims.

What is claimed is:

1. An exhaust system for use in a vehicle having an internal combustion engine with first and second cylinder banks, each having respective first and second exhaust manifolds, the exhaust system comprising:

a first conduit adapted to be coupled to the first manifold;

a second conduit adapted to be coupled to the second manifold;

said first and second conduits extending toward each other downstream of their respective manifolds and past a cross-over point where exhaust gases and associated pressure pulses in the first conduit flow in a direction substantially opposite to flow of exhaust gases and associated pressure pulses in the second conduit; and a common chamber arranged to be in fluid communication with the first and second conduits substantially at the cross-over point.

2. The exhaust system of claim 1 further comprising muffler elements positioned in the first and second conduits upstream of the common chamber.

3. The exhaust system of claim 1 further comprising catalytic converters positioned in the first and second conduits upstream of the common chamber.

4. An exhaust system adapted to be coupled to the first and second exhaust manifolds respectively associated with first and second cylinder banks of an engine having a drive shaft extending substantially parallel to a longitudinal axis of an associated vehicle, the exhaust system comprising:

a first exhaust conduit adapted to be coupled for fluid communication with the first manifold;

a second exhaust conduit adapted to be coupled for fluid communication with the second manifold;

the first and second exhaust conduits positioned such that the first and second exhaust conduits cross over and past one another at a crossing point downstream of the engine substantially on the longitudinal axis so that exhaust gases and associated pressure pulses in the first conduit flow in a direction substantially opposite to flow of exhaust gases and associated pressure pulses in the second conduit; and a common chamber fluidly connecting the first and second exhaust conduits at the crossing point.

5. The exhaust system of claim 4 further comprising muffler elements positioned in the first and second conduits upstream of the common chamber.

6. The exhaust system of claim 4 further comprising catalytic converters positioned in the first and second conduits upstream of the engine.

* * * * *

UNITED STATES PATENT AND TRADEMARK OFFICE

CERTIFICATE OF CORRECTION

PATENT NO. : 6,662,900 B2
DATED : December 16, 2003
INVENTOR(S) : Cathcart et al.

It is certified that error appears in the above-identified patent and that said Letters Patent is hereby corrected as shown below:

Title Page,
Item [74], *Attorney, Agent, or Firm*, insert -- Ralph E. Smith --.

Signed and Sealed this

Eighteenth Day of May, 2004

JON W. DUDAS
*Acting Director of the United States Patent and Trademark Office*